US005389948A

United States Patent [19]

Liu

[11] Patent Number: 5,389,948

[45] Date of Patent: Feb. 14, 1995

[54] DITHERING CIRCUIT AND METHOD

[75] Inventor: Chih-Yuan Liu, Hsinchu, Taiwan, Prov. of China

[73] Assignee: Industrial Technology Research Institute, Hsinchu, Taiwan, Prov. of China

[21] Appl. No.: 837,636

[22] Filed: Feb. 14, 1992

[51] Int. Cl.[6] ..... G09G 3/00

[52] U.S. Cl. ..... 345/147; 345/148

[58] Field of Search ..... 340/703, 793, 750; 378/455, 457; 345/150, 185, 186, 199, 152, 147, 148, 149

[56] References Cited

U.S. PATENT DOCUMENTS

| | | | |
|---|---|---|---|
| 4,377,821 | 3/1983 | Sautter et al. . | |
| 4,706,077 | 11/1987 | Roberts et al. | 340/793 |
| 4,730,185 | 3/1988 | Springer et al. . | |
| 4,821,115 | 4/1989 | Matsushima et al. . | |
| 4,827,255 | 5/1989 | Ishii | 340/703 |
| 4,868,552 | 9/1989 | Chang | 340/703 |
| 4,901,062 | 2/1990 | Morel et al. | 340/703 |
| 4,914,524 | 4/1990 | Kimura . | |
| 4,930,022 | 5/1990 | Kubota . | |
| 4,956,638 | 9/1990 | Larky et al. . | |
| 5,038,300 | 8/1991 | Seiler et al. | 340/703 |
| 5,062,001 | 10/1991 | Farwell et al. | 340/793 |
| 5,068,649 | 11/1991 | Garrett | 340/793 |
| 5,142,276 | 8/1992 | Moffat | 340/750 |
| 5,189,406 | 2/1993 | Humphries et al. | 340/793 |

OTHER PUBLICATIONS

Fundamentals of Interactive Computer Graphics, by Foley and Van Damm, Addison-Wesley Publishing Co., Ltd. 1982, pp. 600–602.

*Primary Examiner*—Richard Hjerpe
*Assistant Examiner*—Gin Goon
*Attorney, Agent, or Firm*—Meltzer, Lippe, Goldstein, et al.

[57] ABSTRACT

A display device with improved color and grey scale capability employs an improved time dependent dithering technique. In the display device, each pixel is controlled so as to be illuminated only a certain number of times during a fixed display time period, the number of illuminations during the time period being dependent on the color or grey scale value of a corresponding pixel in an original image, the frame number, and a dither matrix element. Additionally, the device chooses the particular frames during which a pixel is illuminated so as to give a soft and smooth displayed image with no flashing.

11 Claims, 7 Drawing Sheets

FIG. 1A
X BLACK ● WHITE
| Y \ X | 0 | 1 | 2 | 3 | 4 | 5 | 6 | 7 ••• |
|---|---|---|---|---|---|---|---|---|
| 0 | 0 | 8 | 2 | 10 | 0 | 8 | 2 | 10 |
| 1 | 12 | 4 | 14 | 6 | 12 | 4 | 14 | 6 |
| 2 | 3 | 11 | 1 | 9 | 3 | 11 | 1 | 9 |
| 3 | 15 | 7 | 13 | 5 | 15 | 7 | 13 | 5 ••• |
| 4 | 0 | 8 | 2 | 10 | 0 | 8 | 2 | 10 |
| 5 | 12 | 4 | 14 | 6 | 12 | 4 | 14 | 6 |
| 6 | 3 | 11 | 1 | 9 | 3 | 11 | 1 | 9 |
| 7 | 15 | 7 | 13 | 5 | 15 | 7 | 13 | 5 |
FIG. 1B
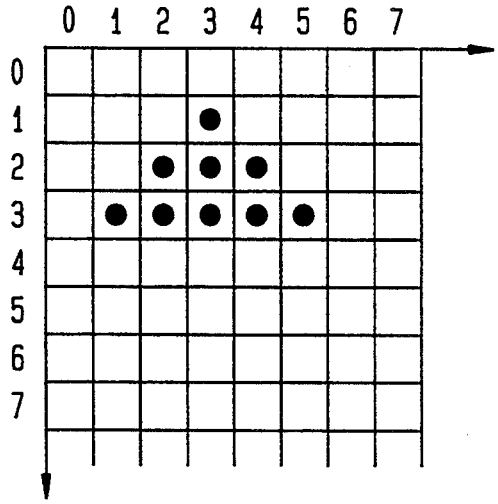
FIG. 1C
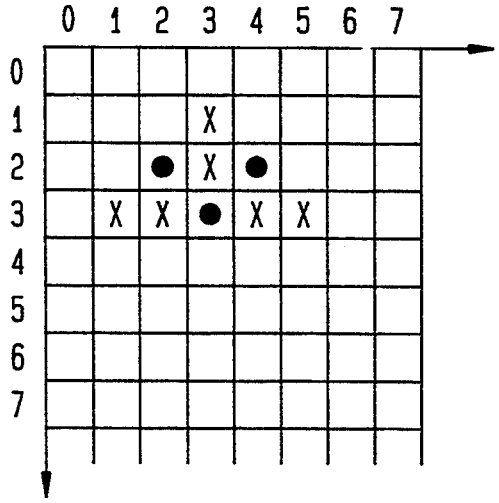
FIG. 1D
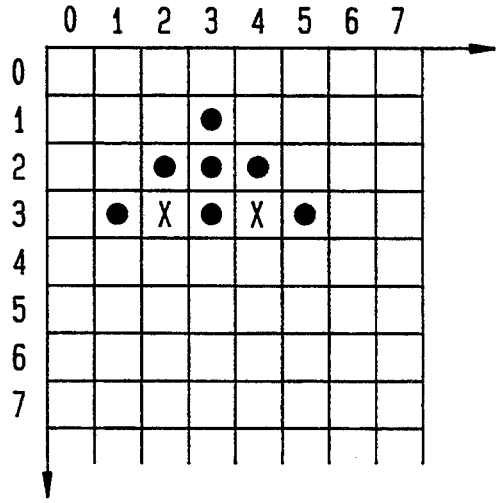

FIG. 3

$A = [FXG]_5 \quad B = [[FXG]_5 + G]_5$

| F | $[FXG]_5$ | $[[FXG]_5 + G]_5$ | $B \geq A$ | $A < D(7,5)$ | $D(7,5) \leq B$ | $B > A$ | I |
|---|---|---|---|---|---|---|---|
| 0 | 0 | 11 | Y | N | N | Y | 0 |
| 1 | 11 | 22 | Y | Y | Y | Y | 1 |
| 2 | 22 | 1 | N | N | N | N | 0 |
| 3 | 1 | 12 | Y | Y | Y | Y | 1 |
| 4 | 12 | 23 | Y | Y | Y | Y | 0 |
| 5 | 23 | 2 | N | N | N | N | 0 |
| 6 | 2 | 13 | Y | Y | Y | Y | 1 |
| 7 | 13 | 24 | Y | Y | Y | Y | 0 |
| 8 | 24 | 3 | N | N | N | N | 0 |
| 9 | 3 | 14 | Y | Y | Y | Y | 1 |
| 10 | 14 | 25 | Y | Y | Y | Y | 0 |
| 11 | 25 | 4 | N | N | N | N | 0 |
| 12 | 4 | 15 | Y | Y | Y | Y | 1 |
| 13 | 15 | 26 | Y | Y | Y | Y | 0 |
| 14 | 26 | 5 | N | N | N | N | 0 |
| 15 | 5 | 16 | Y | Y | Y | Y | 1 |
| 16 | 16 | 27 | Y | Y | Y | Y | 0 |
| 17 | 27 | 6 | N | N | N | N | 0 |
| 18 | 6 | 17 | Y | Y | Y | Y | 1 |
| 19 | 17 | 28 | Y | Y | Y | Y | 0 |
| 20 | 28 | 7 | N | N | N | N | 0 |
| 21 | 7 | 18 | Y | Y | Y | Y | 1 |
| 22 | 18 | 29 | Y | Y | Y | Y | 0 |
| 23 | 29 | 8 | N | N | N | N | 0 |
| 24 | 8 | 19 | Y | Y | Y | Y | 1 |
| 25 | 19 | 30 | Y | N | Y | Y | 0 |
| 26 | 30 | 9 | N | N | N | N | 0 |
| 27 | 9 | 20 | Y | Y | Y | Y | 1 |
| 28 | 20 | 31 | Y | N | Y | Y | 0 |
| 29 | 31 | 10 | N | N | N | N | 0 |
| 30 | 10 | 21 | Y | Y | Y | Y | 1 |
| 31 | 21 | 0 | N | N | N | N | 0 |

DITHERING CIRCUIT AND METHOD

RELATED CASE

An application entitled "Dithering Method and Circuit Using Dither Matrix Rotation" has been filed on even date herewith for the inventor hereof and is assigned to the assignee hereof. The related application bears Ser. No. 07/837,476.

FIELD OF THE INVENTION

The present invention relates to a method and an apparatus that can be used to improve the color and the grey scale capability of a display device capable of displaying a limited number of colors or grey scales. More particularly, the present invention relates to an improved dithering technique which incorporates a time factor for enhancing the color and grey scale capability of a display device.

BACKGROUND OF THE INVENTION

The conventional technique of dithering is utilized to display many colors and grey scales on a display device having relatively few colors and grey scales without having to change the resolution of the display device. For example, through the use of the dithering technique, it is possible to display a 16-color image on a display device having only an 8-color palette. Similarly, by using dithering, it is possible to display an image formed from 16 grey scales on a binary display device in which each pixel can only be turned on or off. The underlying principle of dithering is to rely on a particular spatial distribution of illuminated pixels and non-illuminated pixels to reproduce the color and/or brightness of an original image on the display. When the original image is that of a natural scene such as scenery or portraits, the image displayed by this technique is very close to the original. However, when the original is a computer-generated image, the quality of the displayed image is very much distorted. Conventional dithering is explained in detail in a book entitled, "Fundamentals of Interactive Computer Graphics," by Foley and Van Damm (Addison-Wesley Publishing Co., Ltd., 1982), at pp. 600–602. A 4×4 dither matrix is given therein as follows:

$$D^{(4)}(i,j) = \begin{matrix} D_{00} & D_{10} & D_{20} & D_{30} \\ D_{01} & D_{11} & D_{21} & D_{31} \\ D_{02} & D_{12} & D_{22} & D_{32} \\ D_{03} & D_{13} & D_{23} & D_{33} \end{matrix} = \begin{matrix} 0 & 8 & 2 & 10 \\ 12 & 4 & 14 & 6 \\ 3 & 11 & 1 & 9 \\ 5 & 7 & 13 & 5 \end{matrix}$$

The dither matrix $D^{(4)}$ maps into X–Y space as shown in FIG. 1(*a*). Specifically, $D(X,Y)=D(i,j)$ for $i=X \bmod 4$ and $j=Y \bmod 4$. Conversion between a grey scale representation and a binary representation using conventional dithering may be illustrated by applying the dither matrix $D^{(4)}$ to the triangle shown in FIG. 1(*b*). For each point (X,Y) of the triangle, the following equation is applied:

if $P_{old}(x,y) \geqq D(x,y)$, then $P_{new}(x,y)=1$ else $P_{new}(x,y)=0$ where $P_{old}$ is the value of the pixel at location X,Y in the grey scale representation and $P_{new}$ is the value of the same pixel in the binary representation.

When the grey scale of the triangle in FIG. 1(*b*) is 5 (assuming a total of 16 grey scales with grey scale0=black and grey scale15=white), the results of applying this equation to the triangle are given below and are illustrated in FIG. 1(*c*).

| | |
|---|---|
| $P_{old}(3, 1) = 5 < D(3, 1) = 10$ | $P_{new}(3, 1) = 0$ |
| $P_{old}(2, 2) = 5 > D(2, 2) = 1$ | $P_{new}(2, 2) = 1$ |
| $P_{old}(3, 2) = 5 < D(3, 2) = 9$ | $P_{new}(3, 2) = 0$ |
| $P_{old}(4, 2) = 5 > D(4, 2) = 3$ | $P_{new}(4, 2) = 1$ |
| $P_{old}(1, 3) = 5 < D(1, 3) = 7$ | $P_{new}(1, 3) = 0$ |
| $P_{old}(2, 3) = 5 < D(2, 3) = 13$ | $P_{new}(2, 3) = 0$ |
| $P_{old}(3, 3) = 5 = D(3, 3) = 5$ | $P_{new}(3, 3) = 1$ |
| $P_{old}(4, 3) = 5 < D(4, 3) = 15$ | $P_{new}(4, 3) = 0$ |
| $P_{old}(5, 3) = 5 < D(5, 3) = 7$ | $P_{new}(5, 3) = 0$ |

When the grey scale of the triangle in FIG. 1(*b*) is 11, the results are given below and are illustrated in FIG. 1(*d*).

| | |
|---|---|
| $P_{old}(3, 1) = 11 > D(3, 1) = 10$ | $P_{new}(3, 1) = 1$ |
| $P_{old}(2, 2) = 11 > D(2, 2) = 1$ | $P_{new}(2, 2) = 1$ |
| $P_{old}(3, 2) = 11 > D(3, 2) = 9$ | $P_{new}(3, 2) = 1$ |
| $P_{old}(4, 2) = 11 > D(4, 2) = 3$ | $P_{new}(4, 2) = 1$ |
| $P_{old}(1, 3) = 11 > D(1, 3) = 7$ | $P_{new}(1, 3) = 1$ |
| $P_{old}(2, 3) = 11 < D(2, 3) = 13$ | $P_{new}(2, 3) = 0$ |
| $P_{old}(3, 3) = 11 > D(3, 3) = 5$ | $P_{new}(3, 3) = 1$ |
| $P_{old}(4, 3) = 11 < D(4, 3) = 15$ | $P_{new}(4, 3) = 0$ |
| $P_{old}(5, 3) = 11 > D(5, 3) = 7$ | $P_{new}(5, 3) = 1$ |

As shown by this example, the conventional technique of dithering does not faithfully represent the original image. In both examples, the distribution of illuminated pixels on the binary display is not a faithful reproduction of the original grey scale image.

Other prior art dithering systems also do not perform entirely satisfactorily in representing an original image (see, e.g., Kubota, U.S. Pat. No. 4,930,022); Kimura, U.S. Pat. No. 4,914,524; Springer et al, U.S. Pat. No. 4,730,185; Larky et al, U.S. Pat. No., 4,956,638; Sautter et al., U.S. Pat. No. 4,377,821).

To overcome this disadvantage, the present invention has as its object to provide a method and an apparatus for a display device having relatively few colors or grey scales whereby the capability of the display device is enhanced so as to display faithfully more colors or grey scales than it would otherwise be able to display.

SUMMARY OF THE INVENTION

This object is accomplished in accordance with the present invention by providing a display device in which every pixel is controlled so as to be illuminated only a certain number of times during a predetermined display time period, the number of illuminations during the display time period being dependent on the color or the grey scale value of the pixel. More specifically, a display device in accordance with the present invention employs an improved dithering technique wherein color and/or brightness are represented not just by the spatial distribution of illuminated pixels on a display device, but also by the number of illuminations of a pixel in a predetermined display time period. Thus, the present invention incorporates a time axis in the conventional dithering technique, thereby manipulating the average brightness of every pixel and taking advantage of the persistence of vision in order to represent faithfully color and/or brightness of an original image.

In a preferred embodiment of the invention, the display device comprises a memory unit which stores a dither matrix, a counter which keeps track of the frame count number in a predetermined display time period, a circuit which generates an input intensity value for a pixel at a particular location (i.e., $P_{old}$), and a circuit which determines whether or not to illuminate the pixel during a particular frame (i.e., determines $P_{new}$) depending on the frame count number, the input intensity value of that pixel, and a dither matrix element for the location of that pixel.

As a brief explanation of the inventive technique, consider the example when an original image comprised of 16 grey scale values is to be displayed on a binary display device. Assume that there are 16 frame time units in each predetermined display time period. In accordance with the present invention, a pixel of grey scale $P_{old}=5$ will be illuminated for 5 frame time units during the 16-frame long display time period, while a pixel of grey scale 7 will be illuminated for 7 frame time units during the same 16-frame long display time period. In this manner, the full 16 grey scales can be represented on the display device even though the display device is binary.

In addition, in order to prevent the picture from flashing, it is necessary to control the precise frames or sequence of frames during the 16-frame display time period for which the pixel will be illuminated. In the above example wherein the pixel is illuminated for 5 frame time units during the 16-frame display time period, if the pixel is illuminated for 5 consecutive frames, and is blackened for the following 11 frames, then the picture will flash. On the other hand, if the 5 illuminated frames are distributed evenly during this 16-frame time period, the picture will appear very soft and smooth and there will be no flashing. According to the present invention, this result is achieved through a time dependent dithering. Consequently, a display device having relatively few colors and grey scales is able to represent an original image having many more colors and grey scales.

BRIEF DESCRIPTION OF THE DRAWINGS

FIG. 1(*a*), FIG. 1(*b*), FIG. 1(*c*), FIG. 1(*d*) illustrate the implementation of a conventional dithering technique.

FIG. 2(*a*) illustrates a dither matrix register for use in the circuit of FIG. 1.

FIG. 3 illustrates the implementation of the present inventive technique to an original image.

DETAILED DESCRIPTION OF THE INVENTION

Figure 2:
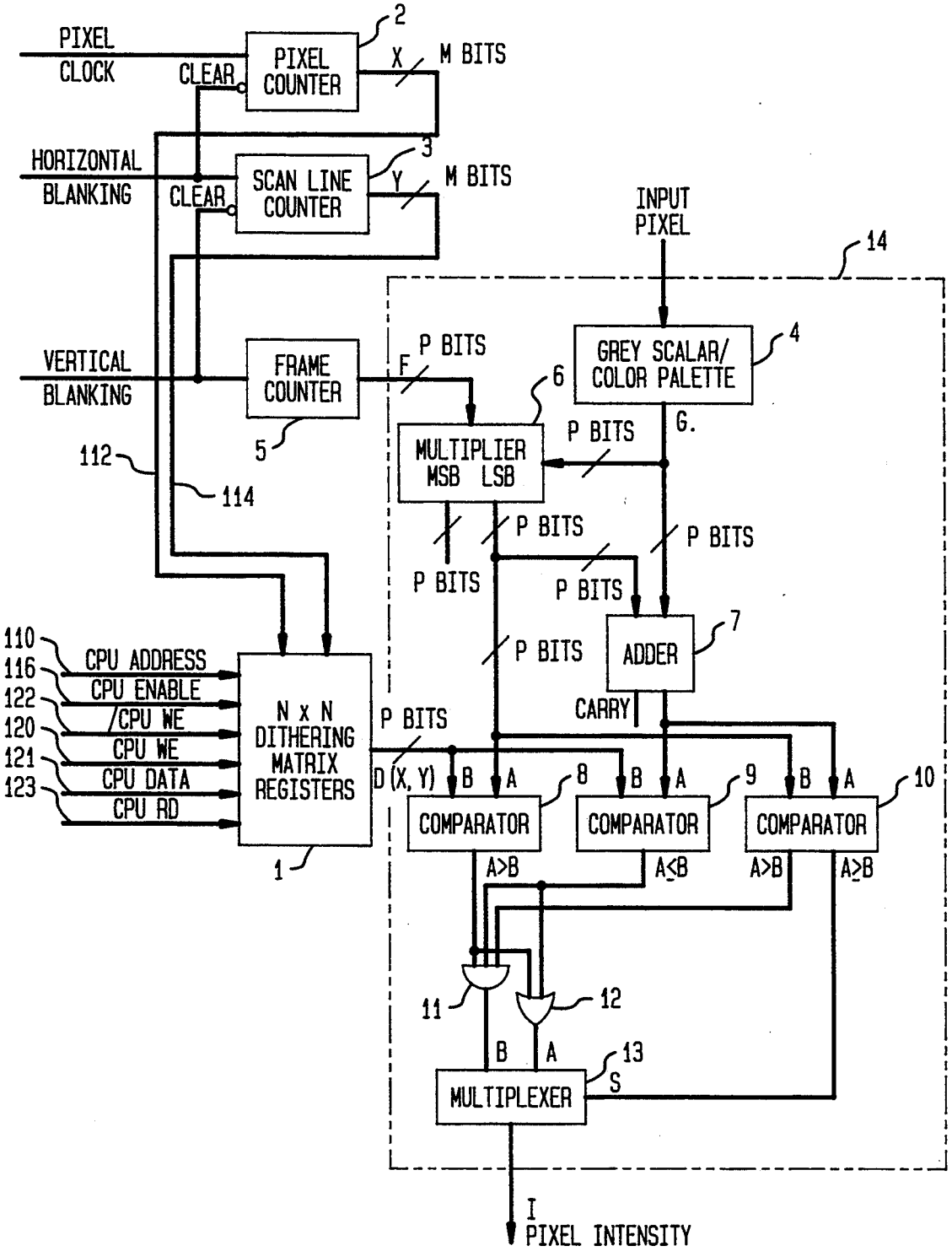
FIG. 2 is a block diagram of a circuit in accordance with an illustrative embodiment of the present invention.
Figure 2A:
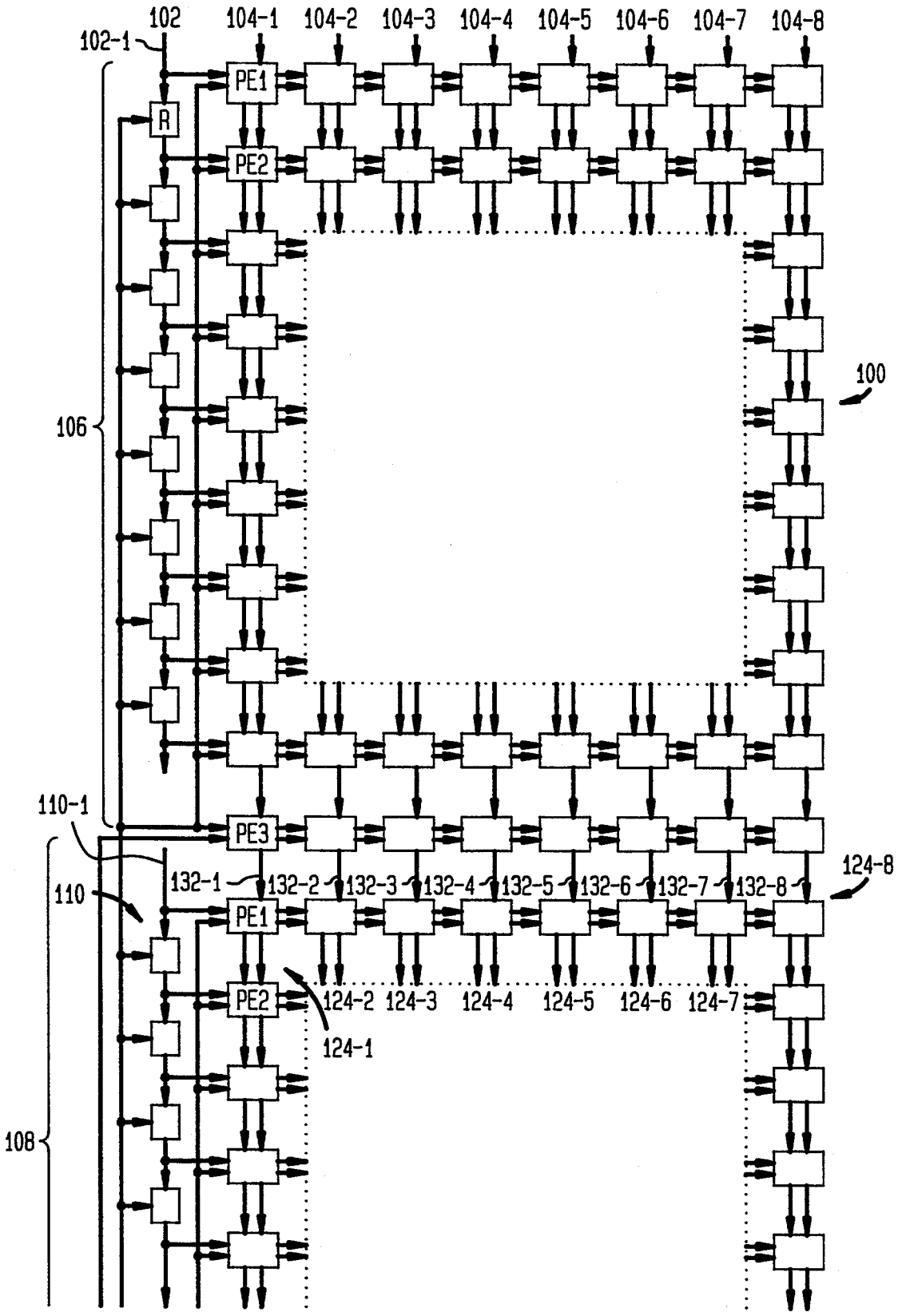

FIG. 2 is a block diagram of a circuit in accordance with a preferred embodiment of the present invention. The circuit of FIG. 2 is utilized to display an image comprising 16 grey scales on a binary display device.

The circuit includes pixel counter 2 which receives a pixel clock signal and keeps track of the X-coordinate of the current pixel on the binary display, and scan line counter 3 which receives a horizontal blanking signal and keeps track of the Y-coordinate of the current pixel on the display. Both the X-coordinate and the Y-coordinate are represented by M-bit numbers. The circuit also includes dither matrix register 1. The matrix is N*N, where $N=2^M$, and the dither matrix register 1 stores the values of the elements of the dither matrix. The current X-coordinate indicated by the pixel counter 2 and the current Y-coordinate selected by scan line counter 3 are used to access a particular dither matrix element D(X,Y) which is output by the dither matrix register 1.

FIG. 2(*a*) illustrates the structure of the dithering matrix register 1 wherein SRAM 101 stores the values of various elements of the dither matrix. The dither matrix elements can be read in or out of the dither matrix register 1 by the programmer through use of the CPU address bus 110 which specifies a particular location in the SRAM 101 or, a matrix element stored in the SRAM 101 can be read out after pixel counter 2, selects the X-coordinate (M bits) via line 112 and scan line counter 3 selects the Y-coordinate (M bits) via line 114. The multiplexer 102 can select either the output from pixel counter 2 and scan line counter 3, namely, X,Y, on the lines 112, 114 or an address on the address bus 110 outputted from a CPU (not shown). When the CPU is executing a read/write transaction, the CPU's enable signal on line 116 is active. In this case, the CPU address bus is to be selected by the multiplexer 102 and connected to the address input terminal 117 of SRAM 101, while at the same time the output enable (OE) terminal of bidirectional transceiver 103 is activated. Because the CPU data bus 121 is connected to the input/output terminal A of bidirectional transceiver 103, and the input/output terminal 118 of SRAM 101 is connected to the input/output terminal B of latch 103, the CPU is able to access data in SRAM 101 through bidirectional transceiver 103. When the CPU is executing a read transaction, the CPU write signal, CPUWE on line 120 will be low, so that the output enable (OE) of SRAM 101 is activated, and data will be outputted. At this time, the CPU read signal, CPURD, on line 123 is also active low, and controls bidirectional transceiver 103 to transmit data from terminal B to terminal A, so that the CPU can read the data in SRAM 101 via CPU data bus 121. Conversely, data can also be written into SRAM 101. In this case the signal/CPUWE is active low so the write enable (WE) of SRAM 101 is activated. In this case, write data is transmitted via data bus 121, terminal A of bidirectional transceiver 103 and terminal B of bidirectional transceiver 103 to the data input 118 of the SRAM. When the CPU is not accessing data in SRAM 101 (i.e. when the CPU is not performing a read or write transaction), the multiplexer 102 will select X and Y addresses produced respectively by pixel counter 2 and scan line counter 3 for connection to the address input terminal 117 of SRAM 101. At this point, CPUWE signal on line 120 is low active, so that the output enable (OE) of SRAM 101 is activated and data is outputted.

Returning now to FIG. 2, the circuit illustrated in FIG. 2 also includes grey scale/color palette 4. For every input pixel intensity value $P_{old}$, the grey scale/color palette 4 will output a value G that is p-bits long. Because the pixels might flash on the display if they are only illuminated for a few frame time units during a relatively long time period (e.g., if they are illuminated for only 1 or 2 frame time units during the 16-frame time display period), it is desirable to increase the number of grey scales from what is intended and to correspondingly increase the number of frame time units in the display period. For instance, if 16 grey scales are to be displayed, a better quality image can be obtained if the number of grey scales is increased to 32 and the number of frame time units in the display period is also increased to 32. This is the function of the grey scale/color palette 4. To accomplish this, an input pixel value for each input pixel is mapped into an output pixel value in the grey scale/color palette 4. In the implementation of the present invention, the output of the grey scale/color palette 4 is G which is a p-bit number which can be utilized to represent $2^p$ grey scales. However, since only $2^{p-1}$ grey scales are contained in the initial image, only $2^{p-1}$ of the $2^p$ grey scales which the grey scale/color palette can output are actually utilized.

The circuit illustrated in FIG. 2 also includes frame counter 5 which receives a vertical blanking signal and keeps track of the frame count for each frame within the display time period. The output from the frame counter 5 is F which is also represented by a p-bit number. The total number of frames displayed during a display time period is $2^p$.

In accordance with the present invention, in every display frame during the full 32-frame display time period, the determination as to whether or not to illuminate each pixel of the binary display device is controlled according to the following equations:

If $[[FxG]_p+G]_p \geqq [FxG]_p$
then if $[FxG]_p < D(X,Y)$ and $[[FxG]_p+G]_p \geqq D(X,Y)$
and $[[FxG]_p+G]_p > [FxG]_p$ then $P_{new}=1$ (1)

else $P_{new}=0$ (2)

else if $[F\times G]_p<D(X,Y)$ or $[[F\times G]_p+G]_p \geqq D(X,Y)$ then $P_{new}=1$ (3)

else $P_{new}=0$ (4), $[\ ]_p$ represents the least significant bit.

The circuit illustrated in FIG. 2 includes processing unit 14 for implementing equations (1)–(4) as follows. The p-bit multiplier 6 implements the multiplication of F and G. The p-bit plus p-bit adder 7 implements the addition of $[[F^*G]_p+G]_p$. Comparator 8 compares the values of $[F^*G]_p$ and D(X,Y), comparator 9 compares the values of $[[F^*G]_p+G]_p$ and D(X,Y), while comparator 10 compares the values of $[[F^*G]_p+G]_p$ and $[F^*G]_p$. The AND-gate 11 performs the operations represented in the equations (1) and (2), while the OR-gate 12 performs the operations represented in equations (3) and (4). The multiplexer 13 selects its output according to the result from comparator 10: when $[[F^*G]_p+G]_p$ is $\geqq[F^*G]_p$, the value from AND-gate 11 will be the output; otherwise, the value from OR-gate 12 will be the output.

So that the implementation of the present invention can be better understood, a specific example in which the circuit illustrated in FIG. 2 is employed in a binary display device will now be described.

For an input image having altogether 16 grey scales which is to be displayed on a display device having only 2 scales of black and white, it is assumed that 16 grey scales will be increased to grey scales by the grey scale/color palette 4. Table 1 below shows the correlation between the 16 original grey scales and the increased 32 grey scales. The 5-bit output G of the grey scale/color palette 4 is shown in the second column of Table 1. The frame counter 5 also contains a 5-bit number F as it counts in a repetitive manner from 0,1,2 , . . . , 31. The third column of Table 1 shows the number of illuminated frames during a full 32-frame display time period required for each grey scale value.

TABLE 1

| Grey Scale of Input Pixel | Output G of Grey Scale/ Color Palette | No. of. Illuminated Frames During 32-Frame Period |
|---|---|---|
| 0 | 0 | 0 |
| 1 | 5 | 6 |
| 2 | 7 | 8 |
| 3 | 9 | 10 |
| 4 | 10 | 11 |
| 5 | 11 | 12 |
| 6 | 15 | 16 |
| 7 | 19 | 20 |
| 8 | 20 | 21 |
| 9 | 21 | 22 |
| 10 | 23 | 24 |
| 11 | 25 | 26 |
| 12 | 27 | 28 |
| 13 | 29 | 30 |
| 14 | 30 | 31 |
| 15 | 31 | 32 |

For this example, the dither matrix register 1 stores an 8×8 dither matrix $D^{(8)}$ (i,j). The contents of the dither matrix register 1 are as follows:

| | D00 | D10 | D20 | D30 | D40 | D50 | D60 | D70 |
|---|---|---|---|---|---|---|---|---|
| | 0 | 16 | 4 | 20 | 1 | 17 | 5 | 21 |
| $D^{(8)}(i,j)$ = | 24 | 8 | 28 | 12 | 25 | 9 | 29 | 13 |
| | 6 | 22 | 2 | 18 | 7 | 23 | 3 | 19 |
| | 30 | 14 | 26 | 10 | 31 | 15 | 27 | 11 |
| | 1 | 17 | 5 | 21 | 0 | 16 | 4 | 20 |
| | 25 | 9 | 29 | 13 | 24 | 8 | 28 | 12 |
| | 7 | 23 | 3 | 19 | 6 | 22 | 2 | 18 |
| | 31 | 15 | 27 | 11 | 30 | 14 | 26 | 10 |

The elements of the dither matrix D(i,j) are mapped into X,Y space such that D(x,y)=D(i,j) for i=x mod 8 and j=y mod 8. The output of the dither matrix register 1 is a five-bit number.

Correspondingly, the pixel counter 2 and the scan line counter 3 both contain 3-bit numbers. Assuming a pixel has the coordinates X=31, Y=69, the output of pixel counter 2 will be i=31 mod 8=7, and the output of scan line counter 3 will be j=69 mod 8=5. Therefore, the output of the dither matrix register 1 is D(x,y)=D(i=7,j=5)=12.

In this example, it is further assumed that the grey scale of an input pixel is 5. After it passes through grey scale/color palette 4, it has a new grey scale of 11 as shown in Table 1. Furthermore, during the 32-frame display time, it is seen from Table 1 that the corresponding pixel on the display device is to be illuminated 11 times.

Taking these assumptions into account, the circuit illustrated in FIG. 2 processes a pixel whose coordinates are (X,Y)=(31,69) and whose grey scale value is 5, in accordance with equations (1)-(4). The results of this processing for this pixel are shown in FIG. 3, wherein the last column indicates whether the pixel located at the coordinates (31,69) will be illuminated during any particular frame of the 32-frame time period. It is noted from FIG. 3 that the distribution of bright and dark frames of the same pixel during a 32-frame display period is even. As a result, there is presented a very smooth and soft display on the screen, the dark and bright intervals being spaced evenly, and the grey scale being 11 on a full scale of 32.

Figure 4:
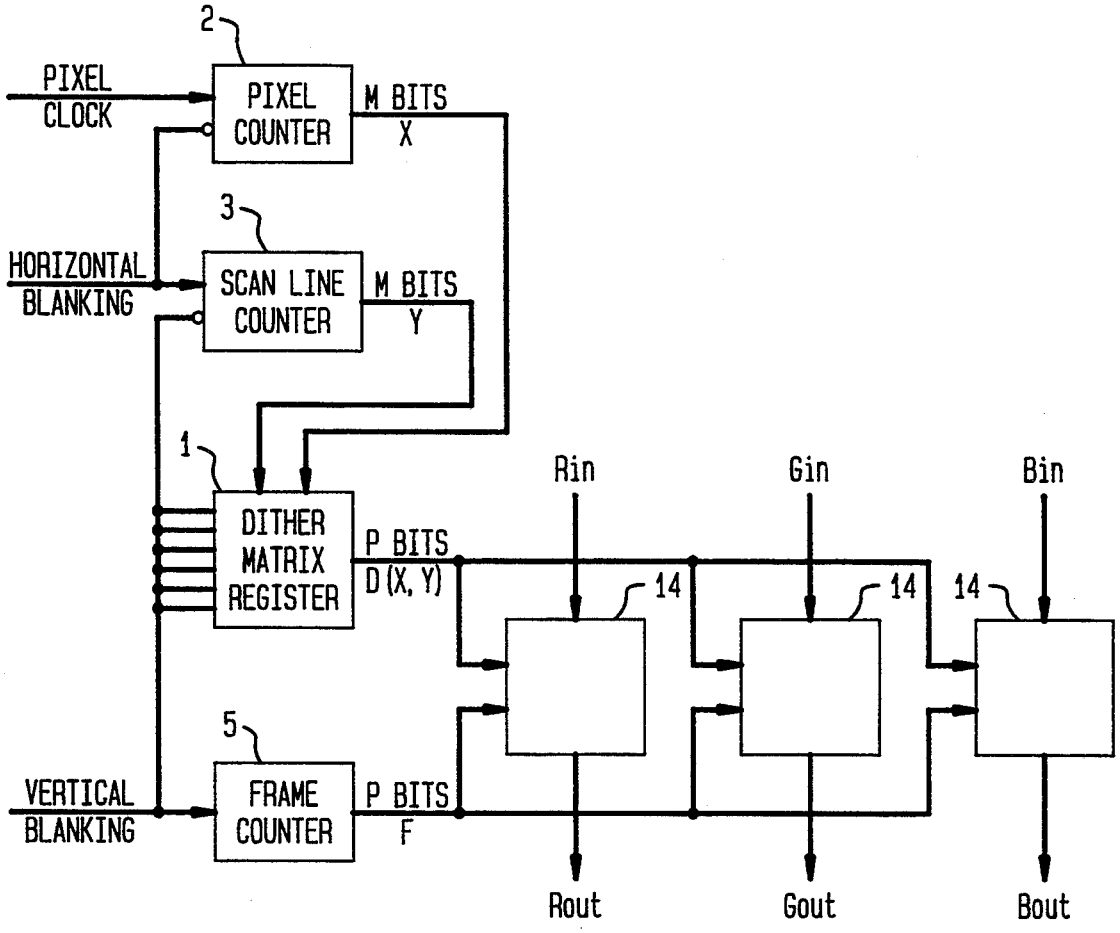
FIG. 4 illustrates an embodiment of the present invention for a color display device.

FIG. 4 is a block diagram of a circuit of the present invention applied to a color display device. It is different from the circuit of FIG. 2 in that block 14 appears three times. This is because the three primary colors red, blue and green are processed separately by the individual blocks 14 so that a color display device is enabled to display pictures with many more colors.

Figure 5:
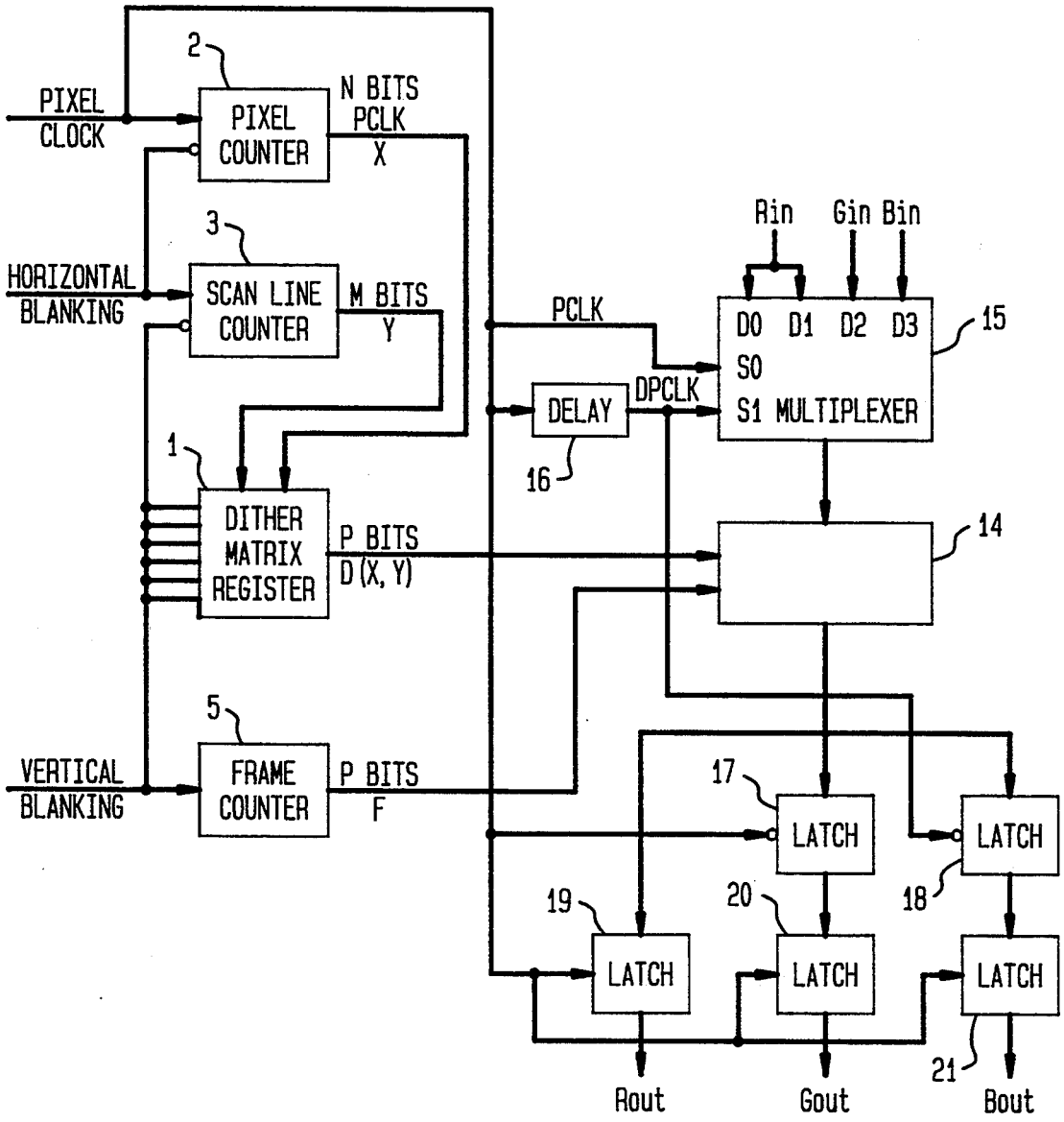
FIG. 5 illustrates another embodiment of the present invention for a color display device.

When the pixel frequency is slow or the processing speed of block 14 is fast enough, a different technique, illustrated in FIG. 5, can be used for a color display device which will achieve the same effect as the circuit of FIG. 4 but with fewer processing units. In the circuit of FIG. 5, the delay device 16 delays the pixel clock by a quarter of a clock cycle. The multiplexer 15 is controlled by the signal PCLK from the pixel clock and the output DPCLK from the delay device 16 to select which one of the pixel intensity values $R_{in}$, $G_{in}$, or $B_{in}$ should be transmitted to the multiplexer output. Table 2 below shows the output from multiplexer 15 depending on the state of PCLK and DPCLK.

TABLE 2

| PCLK (Output of clock Signal) | DPCLK (Output of Delay Device 16) | Output of Multiplexer 15 |
|---|---|---|
| 0 | 0 | $B_{in}$ |
| 0 | 1 | $G_{in}$ |
| 1 | 0 | $R_{in}$ |
| 1 | 1 | $R_{in}$ |

After being processed by the processing unit 14, $R_{in}$, $G_{in}$, and $B_{in}$ will be stored up separately by the latches 17-21. Latch 17 latches the output of block 14 at the falling edge of PCLK, and stores the processed data for the red color. Latch 18 latches the output of block 14 at the falling edge of DPCLK, and stores the processed data for green color. Latch 21 latches the output of block 14 at the rising edge of PCLK, and stores the processed data for blue color. At the same time, latch 20 and latch 21 respectively latch the outputs of latch 17 and latch 18. In other words, the output $R_{out}$ of latch 19, the output $G_{out}$ of latch 20, and the output $B_{out}$ of latch 21, are simultaneously obtained and outputted at the rising edge of PCLK.

Figure 6:
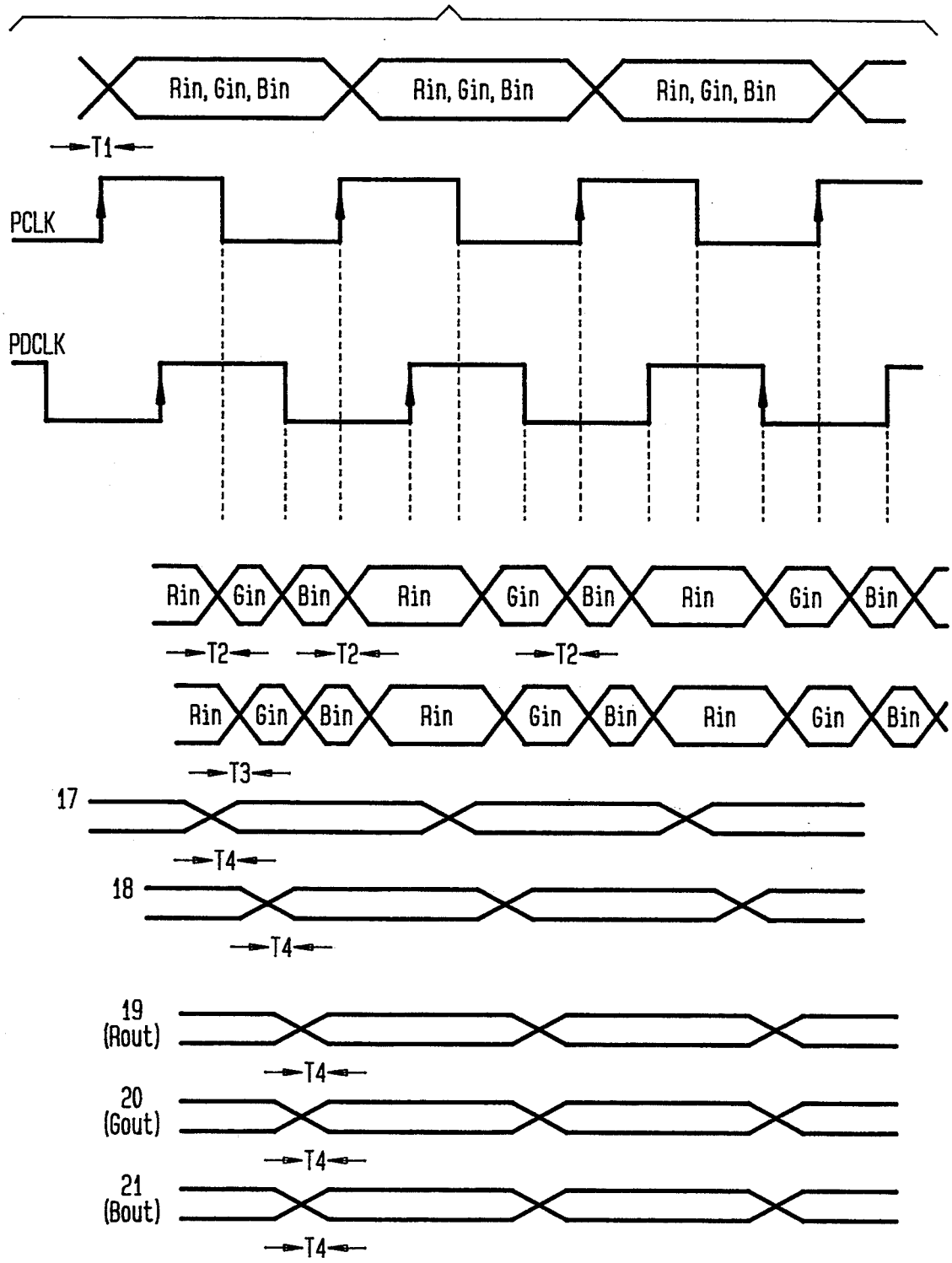
FIG. 6 illustrates a timing sequence for the important signals of the circuit shown in FIG. 5.

FIG. 6 illustrates the timing sequence of the circuit shown in FIG. 5. In FIG. 6, T1 represents the rising edge of PCLK and the delay time of the pixel data $R_{in}$, $G_{in}$, and $B_{in}$. T2 represents the logic delay time of multiplexer 15. T3 is the logic delay time of block 14, and T4 is the logic delay time of latches 17-21.

To summarize, the present invention discloses an efficient apparatus and method to increase the color display capability and the grey scale display capability of a display device. The advantages can be outlined as follows:

(1) The cost of equipment can be reduced since a display device containing a small number of colors or grey scale values can now be used as a substitute for a display device that has many more colors or grey scale values and is more expensive.

(2) The invention is self-contained, expandable, and easy to implement either on a circuit board or by an ASIC.

(3) A faithful representation of the resolution, color, and brightness of an original image is achieved.

(4) The hardware architecture contains a programmable dither matrix register and a programmable grey scale/color palette so that an appropriate selection of values will result in the best possible display.

(5) The present invention is especially applicable to LCD displays. Since LCDs have been extensively used in laptop and notebook computers, the commercial value of the invention is apparent.

While the invention has been described by reference to specific embodiments, this was for purposes of illustration only. Numerous alternative embodiments will be apparent to those skilled in the art, and are considered to be within the spirit and the scope of the invention.

I claim:

1. A system for improving the display capability of a display device, comprising means for generating the X, Y coordinates of each pixel in each frame of said display, means for storing a dither matrix and for accessing a dither matrix element D(X,Y) in response to the X,Y coordinates of each pixel, means for generating a frame count number F for each frame in a time period comprising a predetermined number of frames, means for generating an input intensity value G(X,Y) corresponding to each pixel with coordinates X,Y in each frame of said display device, means for multiplying said frame count number F and said input intensity value G(X,Y), circuit means operative during a frame in said time period for determining an output pixel intensity value I(X,Y) representing the illumination of a pixel with the coordinates X,Y in the display device during each frame in response to said dither matrix element D(X,Y), said frame count number F, said input intensity value G(X,Y), and a product (F * G(X,Y)) from said means for multiplying, means for adding said product (F * G(X,Y)) and said input intensity value G(X,Y), first means for comparing said product (F * G(X,Y)) with said dither matrix element D(X,Y), second means for comparing said dither element D(X,Y) with said addition ((F * G(X,Y))+G(X,Y)), third means for comparing said product (F * G(X,Y)) with said addition ((F * G(X,Y))+G(X,Y)), and said circuit generating an output pixel intensity in response to results from said three means for comparing.

2. The system of claim 1 wherein said means for storage dither matrix comprises a random access memory, a multiplexer for enabling the coordinates of a pixel or an address generated by a CPU to be transmitted to said memory, and a bidirectional transceiver for transmitting write data to be written into said memory by said CPU or read out of said memory by said CPU.

3. The system of claim 1 wherein said means for generating an input intensity value includes a palette which receives an input value for each pixel of an original image and maps said input value into an intensity value which serves as said input intensity value.

4. The system of claim 1 wherein said means for generating an input intensity value for each pixel of an original image maps an input value for each pixel into an intensity value which serves as an input intensity value.

5. The system of claim 1 wherein said display device is a black and white display device and said means for generating an input intensity value generates a grey scale value.

6. The system of claim 1 wherein said display device is a color display device and said means for generating an input intensity value generates separate color input intensity values for each of the colors red, green and blue.

7. The system of claim 6 comprising three intensity value generating means for generating the separate color input intensity values, and three circuit means for processing said three separate color input intensity values.

8. The system of claim 6 further comprising multiplexing means for receiving three separate color input intensity values of an original image for each of the colors red, green, and blue, and for delivering said separate color input intensity values to said circuit means with a delay so that said separate color input intensity values can be processed by said circuit means.

9. A method for improving the display capability of a display device comprising generating coordinates X,Y of each pixel in each frame of said display device, accessing a memory storing a dither matrix in response to said X,Y coordinates of each pixel in each frame to retrieve a dither matrix element D(X,Y), generating a frame count number F of each frame in a display time period comprising a predetermined number of frames of said display device, inputting into a processing unit for each pixel in each frame in the display time period, an input intensity G(X,Y) of a pixel with coordinates X,Y, a dither matrix value D(X,Y), and a frame count number F, multiplying said input intensity G(X,Y) by said frame count number F, outputting from said processing unit an output intensity I(X,Y) for each pixel with coordinates of each frame of said display device in response to said dither matrix element D(X,Y), said frame count number F, said input intensity value G(X,Y), and a product (F * G(X,Y)) from said means for multiplying, adding said product (F * G(X,Y)) to said input intensity value G (X,Y), comparing said product (F * G(X,Y)) with said dither matrix element D(X,Y), comparing said dither matrix element D(X,Y) to said addition ((F * G(X,Y))+G(X,Y), comparing said product (F * G(X,Y)) to said addition ((F * G(X,Y))+G(X,Y)), and generating an output pixel intensity in response to said three comparisons.

10. A binary display device capable of displaying a multiple intensity scale image comprising a circuit which represents an input pixel having a specific multiple intensity scale value by illuminating a corresponding pixel on said binary display for a specific number of frames in a display period, the specific number of illuminated frames being proportionate to the specific multiple intensity scale value, said number of illuminated frames being spread evenly over said display period, wherein said multiple intensity scale value G(X,Y) is a grey scale value, and said circuit comprises:

means for generating the coordinates X,Y of a pixel, means for storing a dither matrix and outputting a specific dither matrix element D(X,Y) in response to the coordinates X,Y of a pixel, means for maintaining a frame count number F in said display period, means for multiplying said multiple intensity scale value G(X,Y) with said frame count number F, means responsive to the dither matrix element D(X,Y), said frame count F, said specific grey scale value G(X,Y) and a product (F * G(X,Y)) of the means for multiplying for the pixel with coordinates X,Y for determining whether said corresponding pixel with coordinates X,Y on said binary display should be illuminated in each frame of said display period, means for adding said product (F * G(X,Y)) and said input intensity value G(X,Y), first means for comparing said product (F * G(X,Y)) with said dither matrix element D(X,Y), second means for comparing said dither element D(X,Y) with said addition ((F * G(X,Y))+G(X,Y)), a third means for comparing said product (F * G(X,Y)) with said addition ((F * G(X,Y))+G(X,Y)), and said circuit generating an output pixel intensity in response to results from said three means for comparing.

11. The device of claim 10 wherein said display is capable of displaying an image comprising multiple intensity scales in a plurality of colors.

* * * * *